US005725439A

United States Patent [19]

Halsey et al.

[11] Patent Number: 5,725,439

[45] Date of Patent: Mar. 10, 1998

[54] GOLF CLUB ALIGNMENT DEVICE

[76] Inventors: Keith D. Halsey, 2824 2nd St., Santa Monica, Calif. 90405; Witold F. Siekaj, 20812 Hillside, Topanga, Calif. 90408

[21] Appl. No.: 588,702

[22] Filed: Jan. 19, 1996

[51] Int. Cl.[6] ..... A63B 69/36

[52] U.S. Cl. ..... 473/220; 362/259; 473/409

[58] Field of Search ..... 473/220, 238; 362/259

[56] References Cited

U.S. PATENT DOCUMENTS

| | | | |
|---|---|---|---|
| 2,923,552 | 2/1960 | Sundberg | 473/238 |
| 3,170,698 | 2/1965 | Schoeffler et al. | 273/163 |
| 3,198,525 | 8/1965 | Smith | 273/163 |
| 4,930,787 | 6/1990 | Nobles, Jr. | 273/186 |
| 4,938,479 | 7/1990 | Jenkins et al. | 273/29 |
| 5,158,212 | 10/1992 | Sirhan | 222/175 |
| 5,169,150 | 12/1992 | Tindale | 273/187.4 |
| 5,207,429 | 5/1993 | Walmsley et al. | 273/186.2 |
| 5,213,331 | 5/1993 | Avanzini | 273/186.3 |
| 5,388,831 | 2/1995 | Quadri et al. | 273/186.3 |
| 5,388,832 | 2/1995 | Hsu | 273/186.3 |
| 5,465,972 | 11/1995 | Cornett | 273/186.3 |
| 5,611,739 | 3/1997 | Carney | 473/220 |

FOREIGN PATENT DOCUMENTS

| | | | |
|---|---|---|---|
| 2-23974 | 1/1990 | Japan | A63B 53/00 |
| 2-144081 | 1/1990 | Japan | A63B 69/00 |

*Primary Examiner*—George J. Marlo
*Attorney, Agent, or Firm*—Aquilino & Welsh

[57] ABSTRACT

A golf club laser alignment device for attachment to a golf club having a face. The alignment device includes a mounting bracket supporting a laser assembly above the face of a golf club for properly aligning a golf club. The mounting bracket includes a distal end adapted for attachment to the face of a golf club and a proximal end supporting the laser assembly. The device is further provided with a laser assembly including lateral adjustment rings permitting the laser assembly to be selectively adjusted along the face of a golf club. In use, the device is selectively attached to the face of a golf club, the device is then laterally and rotationally adjusted relative to the face of the golf club and the laser alignment device is activated to confirm the alignment of the golf club.

20 Claims, 5 Drawing Sheets

GOLF CLUB ALIGNMENT DEVICE

BACKGROUND OF THE INVENTION

1. Field of the Invention

The invention relates to golf club alignment devices. More particularly, the invention relates to laser alignment devices for putters, and a method for using the alignment device.

2. Description of the Prior Art

When playing the game of golf, the putting stroke presents anywhere between 30 and 50 percent of the total number of strokes taken during a round. While there are a number of factors which determine whether a putt finishes in or close to the hole, the most important of these is the path that the putter head takes during the execution of the stroke. In order to be consistent in striking the ball so that it rolls on the preselected path, there are several conditions which must be met. First, the putter must be swung on a consistent path. Second, the putter must strike the ball at or near the center of percussion (that is, the "sweet spot") of the club head, and the blade of the putter must be held in precise alignment with the target line.

Many devices have been developed to help golfers perfect their golf strokes. Among these devices are laser alignment devices secured adjacent the club head to permit a golfer to readily determine whether he or she is addressing and striking the ball properly.

Laser devices are generally very helpful to golfers in determining whether the face of the putter is properly aligned with the target. In particular, a golfer will mount the laser device on the golf club and direct it toward the desired target. If the laser device is mounted properly, the laser will reflect off the desired target when the golfer addresses or strikes the ball in the desired manner. Similarly, laser devices may be used to determine whether the ball has been struck in the sweet spot of the club. This is accomplished by directing the laser light from a properly mounted laser device to a point just in front of the club's sweet spot. When a golfer addresses or strikes a ball, the laser should pass through the center of the ball.

While laser devices are often helpful in improving the putting of golfers, prior laser alignment devices are cumbersome, difficult to use, and limited in their versatility. In view of the shortcomings of prior laser alignment devices, a need continues to exist for a convenient, versatile, and reliable laser alignment device and method of use. The present invention provides such a device, and method for use.

SUMMARY OF THE INVENTION

It is, therefore, an object of the present invention to provide a golf club laser alignment device for attachment to a golf club having a face. The alignment device includes a mounting bracket supporting a laser assembly above the face of a golf club for properly aligning the golf club. The mounting bracket includes a distal end adapted for attachment to the face of the golf club and a proximal end supporting the laser assembly.

It is also an object of the present invention to provide a golf club laser alignment device including a mounting bracket supporting a laser assembly above the face of a golf club for properly aligning a golf club, wherein the laser assembly includes lateral adjustment rings permitting the laser assembly to be selectively adjusted along the face of a golf club.

It is another object of the present invention to provide a golf club laser alignment device that may be activated by a voice activation mechanism to avoid unnecessary body movements.

A further object of the present invention is to provide a method for the laser alignment of a golf club. The method is accomplished by selectively attaching a laser alignment device to the face of a golf club, the laser alignment device including a mounting bracket supporting a laser assembly for lateral and rotational adjustment. The laser alignment device is then laterally and rotationally adjusted relative to the face of the golf club and the laser alignment device is activated to confirm the alignment of the golf club.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
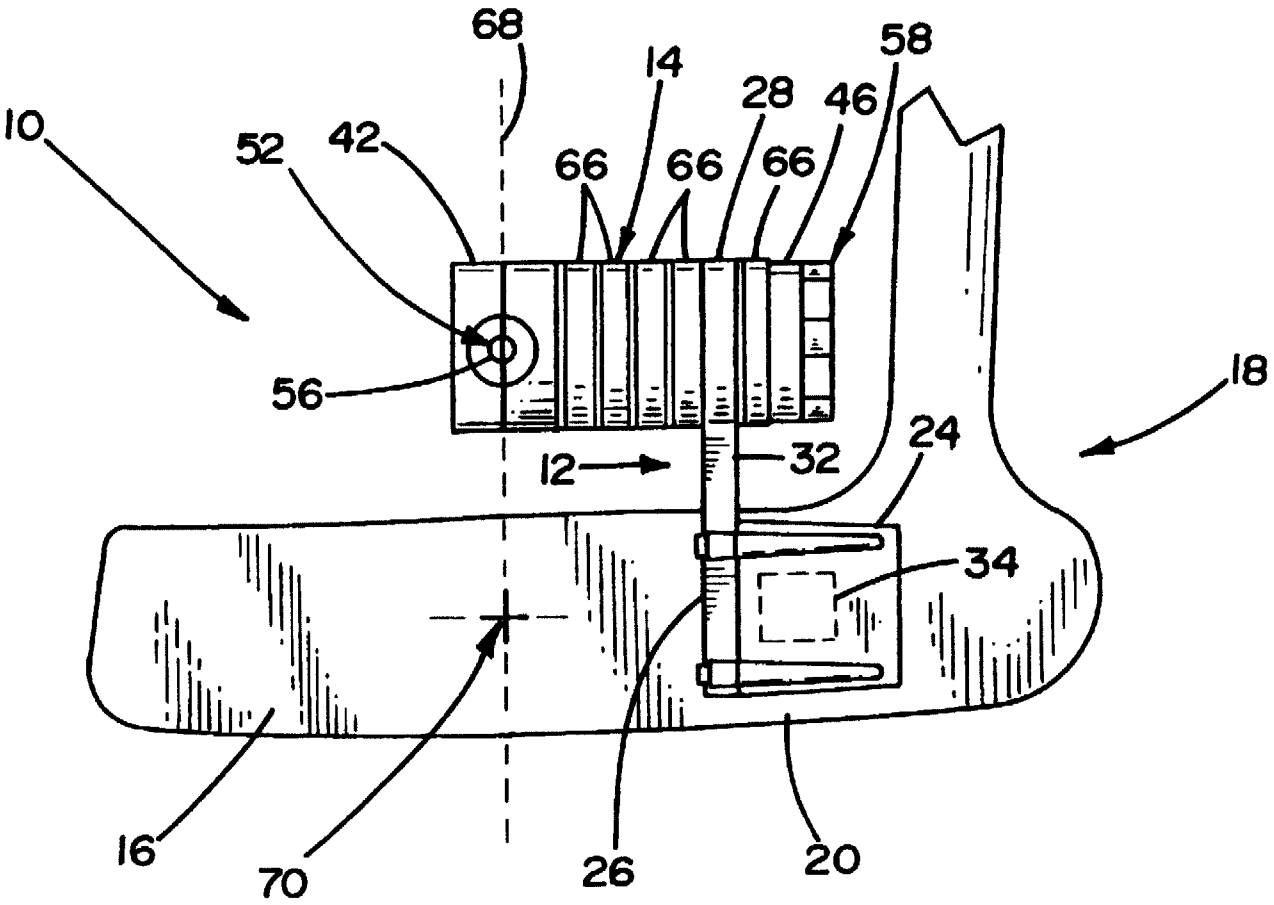
FIG. 1 is a front view of the laser alignment device secured to the face of a putter.
Figure 2:
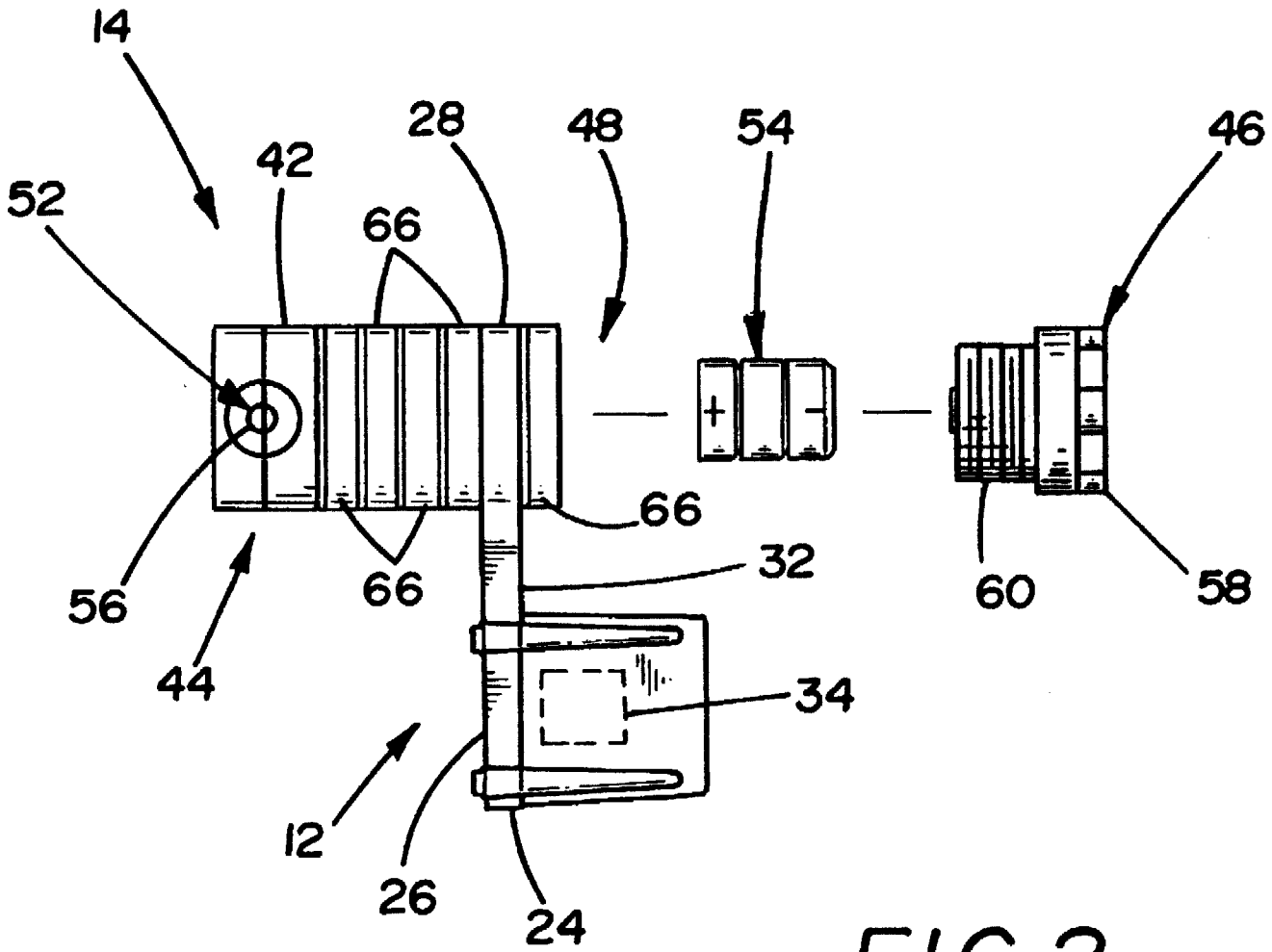
FIG. 2 is a partial exploded view of the laser alignment device.
Figure 3:
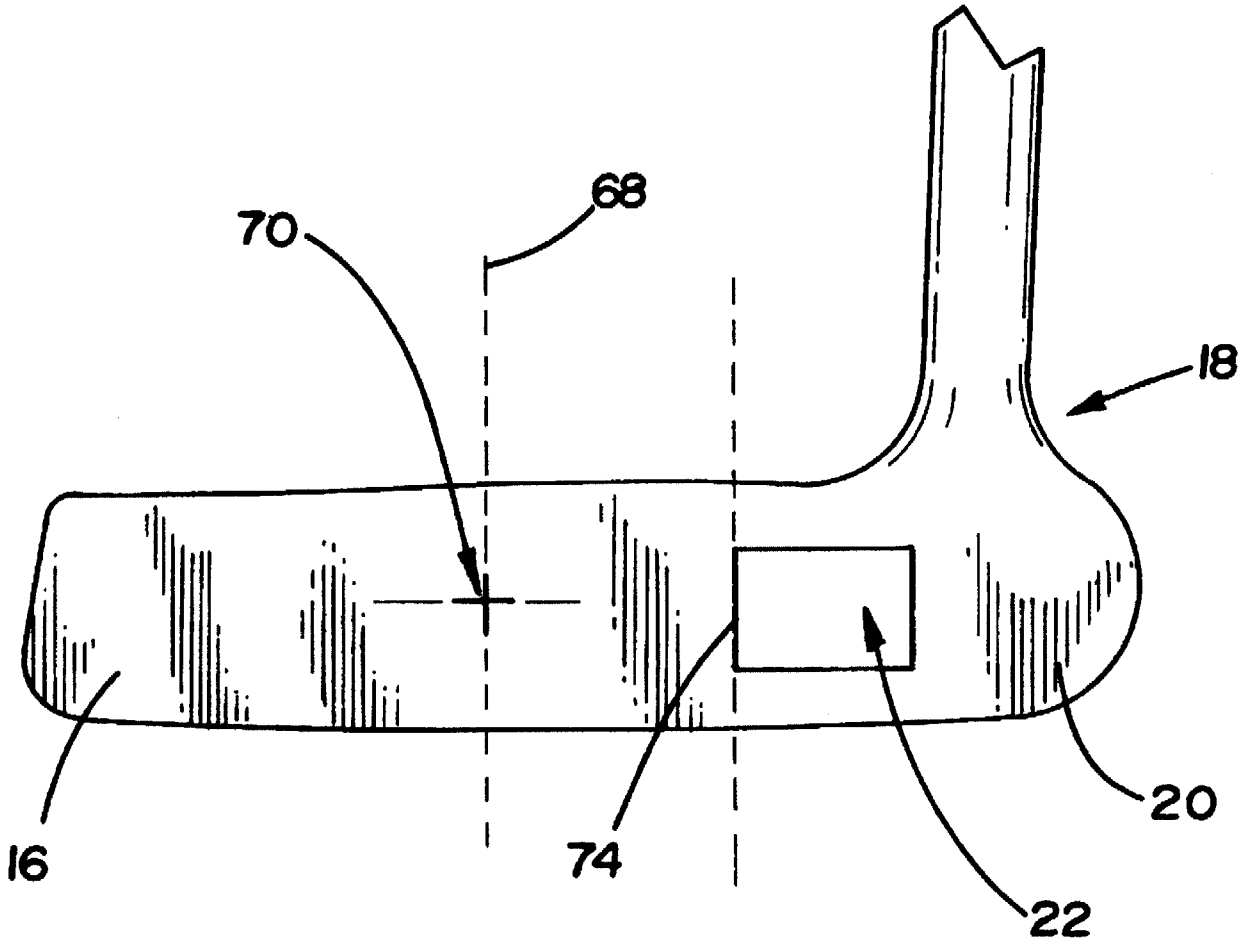
FIG. 3 is a front view of the putter face with a metal plate secured thereto.
Figure 4:
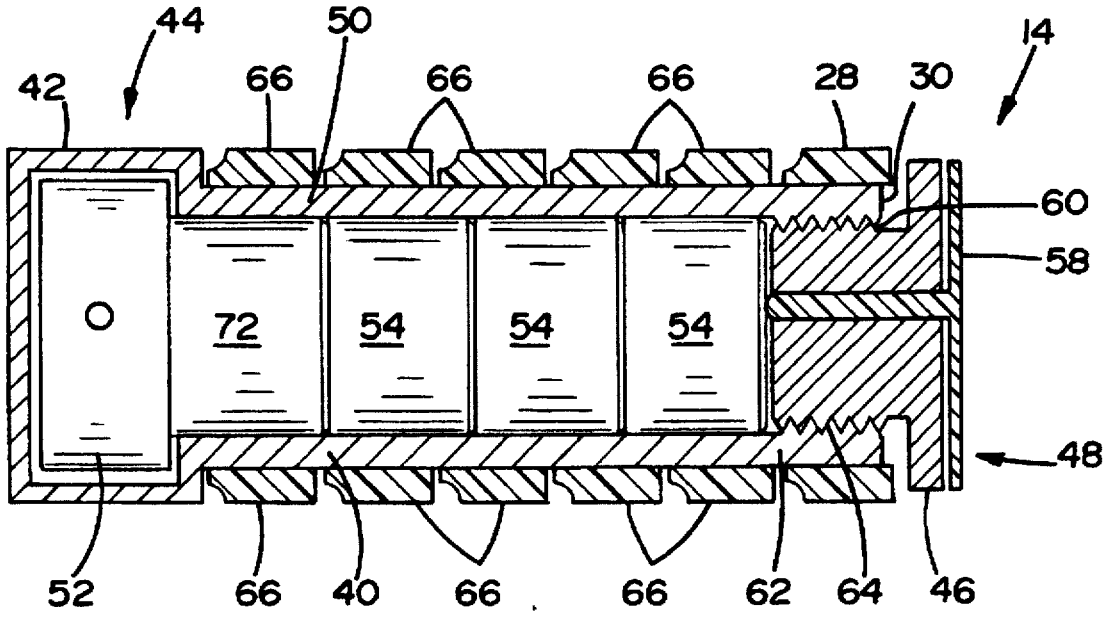
FIG. 4 is a cross-sectional view of the laser assembly.
Figure 5:
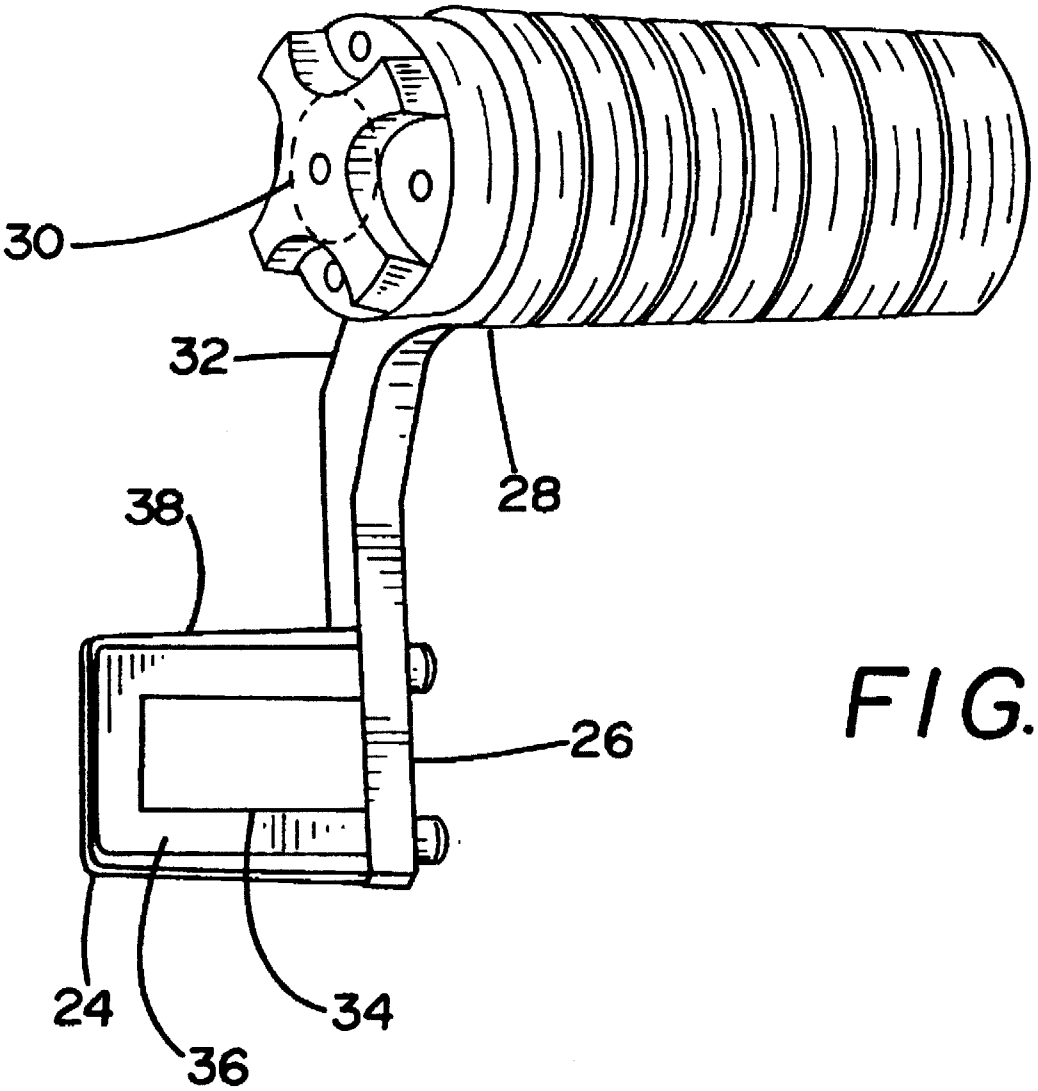
FIG. 5 is a perspective view of the mounting bracket.

With reference to FIG. 1, the laser alignment device 10 includes a mounting bracket 12 supporting a laser assembly 14. Briefly, the laser alignment device 10 is releasably secured on the face 16 of a golf club 18, preferably, a putter, by securing the mounting bracket 12 at the heel 20 of the golf club's face. Attachment of the mounting bracket 12 is facilitated by a metal plate 22 attached to the heel 20 on the face 16 of the putter 18 which interacts with a magnetic attachment member 24 at the distal end 26 of the mounting bracket 12. While the use of the alignment device 10 will be described below with regard to a putter, it should be understood that the alignment device 10 could be used with a variety of golf clubs without departing from the spirit of the present invention.

The mounting bracket 12 includes a distal end 26 and a proximal end 28. The proximal end 28 of the mounting bracket 12 includes a central opening 30 in which the laser assembly 14 is supported in a manner that will be discussed in greater detail below.

The proximal end 28 of the mounting bracket 12 is substantially disc shaped and the opening 30 is positioned in the center thereof. The proximal end 28 of the mounting bracket 12 is attached to the distal end 26 of the mounting bracket 12 by a substantially L-shaped arm 32.

The distal end 26 of the mounting bracket 12 includes a magnetic attachment member 24 connected thereto. The magnetic attachment member 24 is a substantially flat member, shaped for selective attachment to the face of a putter in a manner that will be discussed in greater detail below. The attachment member 24 is attached at the distal end 26 of the mounting bracket 12 in a first plane which is perpendicular to the plane in which the proximal end 28 of the mounting bracket 12 is positioned. As a result, the laser assembly 14 is always mounted in alignment with the face 16 of the putter 18. That is, since the face 16 of the putter 18 is always flat, the perpendicular relationship between the attachment member 24 and the proximal end 28 of the mounting bracket 12 guarantees the correct alignment of the laser assembly 14 relative to the face 16 of the putter 18.

The attachment member 24 is provided with a magnet 34 positioned in the first face 36 of the attachment member 24. The magnet 34 is designed to engage the metal plate 22 secured on the face 16 of the putter 18. The first face 36 is also provided with a guiding edge 38 used to properly align the mounting bracket 12 on the face 16 of the putter 18. The guiding edge 38 defines a rectangular recess in which the metal plate 22 fits. In addition, the magnet 34 is positioned within the recess and is exposed to facilitate selective mounting of laser alignment device 10 to the face 16 of the putter 18.

The laser assembly 14 includes a housing 40 having a proximal hub 42 positioned at the proximal end 44 and a distal hub 46 positioned at the distal end 48. The proximal hub 42 and the distal hub 46 are connected by a central housing portion 50. A laser light 52 is positioned within the proximal hub 42 and is powered by batteries 54 stored within the central housing portion 50. The laser light 52 transmits a laser beam through a hole 56 in the proximal hub 42 of the laser assembly 14.

The distal hub 46 houses an on/off switch 58 and is removably attached to the central housing portion 50. Specifically, the distal hub 46 is selectively screwed onto the central housing portion 50. Accordingly, the distal hub 46 is provided with a threaded male member 60, while the distal end 62 of the central housing portion 50 is provided with a threaded female member 64 shaped to receive the male member.

The central housing portion 50 has a diameter which is smaller than the diameter of either the proximal hub 42 or the distal hub 46. A plurality of lateral adjustment rings 66 are positioned along the central housing portion 50. The rings 66 have an inner diameter slightly larger than the diameter of the central housing portion 50 and an outer diameter that is approximately the same as the diameter of the proximal hub 42 and the distal hub 46. The rings 66 may be selectively removed from the laser assembly 14 by unscrewing the distal hub 46 and sliding a desired number of rings 66 from the central housing portion 50. Removal of the rings 66 is provided to permit adjustment of the laser assembly 14 relative to mounting bracket 12 in a manner that will be discussed in greater detail.

The laser assembly 14 is attached to the mounting bracket 12 by removing the distal hub 46 and passing the central housing portion 50 through the opening 30. The distal hub 46 is then screwed back onto the central housing portion 50 to properly secure the housing 40 within the opening 30. Since the opening 30 in the proximal end 28 of the mounting bracket 12 is slightly smaller than the outer diameter of the central housing portion 50, the laser assembly 14 will rotate when it is supported on the mounting bracket 12.

With regard to the lateral adjustment rings 66, they are positioned on either side of the proximal end 28 of the mounting bracket 12 to properly align the laser alignment device 10. That is, the rings 66 may be removed from the central housing portion 50 and selectively positioned on either side of the proximal end 28 of the mounting bracket 12 until the laser assembly 14 is properly aligned with the horizontal axis 68 extending through the sweet spot 70 on the face 16 of the putter 18. As a result of the lateral adjustment rings 66 and the opening 30 in the proximal end 28 of the mounting bracket 12, the laser assembly 14 is supported by the mounting bracket 12 in a manner permitting the laser assembly 14 to be laterally and rotationally adjusted relative to the mounting bracket 12.

once the laser assembly 14 is turned on by the on/off switch 58, activation of the laser light is controlled by a voice activated assembly 72. As a result, the user need only say "ON" or "OFF" to respectively activate or deactivate the laser light 52. The voice activated assembly 72 enables a user to control the laser light 52 without moving his or her hands from the putter grip to manually activate the laser light 52 with buttons and switches. While the voice activated assembly is the preferred structure for controlling the laser light, other activation mechanisms could be used in conjunction with the alignment device.

In use, an individual first secures a square or rectangular metal plate 22 to the front face 16 of his or her putter 18. The metal plate 22 is preferably secured to the heel 20 on the face of the putter such that the edge 74 of the metal plate 22 is parallel to the horizontal axis 68 extending through the sweet spot 70 of the putter. Two-sided adhesive tape (not shown) may be used to secure the metal plate 22 to the face 16 of the putter 18, although other manners of attaching the metal plate to the putter could be used without departing from the spirit of the invention.

Once the metal plate 22 is properly positioned on the face of the putter, the mounting bracket 12 of the alignment device 10 is selectively attached to the face 16 of the putter 18 by placing the first face 36 of the magnetic attachment member 24 over the metal plate 22. Alignment of the mounting bracket 12 on the putter 18 is facilitated by the guiding edge 38. That is, the guiding edge 38 is substantially the same shape as the metal plate 22 and is slightly larger than the metal plate 22. As a result, the guiding edge 38 creates a cavity in which the metal plate 22 snugly sits when the mounting bracket is properly attached to the putter face 16.

After the mounting bracket 12 is selectively secured to the putter face 16, the hole 56 through which the laser light is transmitted must be aligned with the horizontal axis 68 passing through the sweet spot 70 of the putter 18. This is accomplished by unscrewing the distal hub 46 and moving the lateral adjustment rings 66 from one side of the proximal end 28 of the mounting bracket 12 to the other side of the proximal end 28 of the mounting bracket 12 until the laser light hole 56 is aligned with the horizontal axis 68 of the sweet spot 70.

The laser assembly 14 is then laterally adjusted to align with the horizontal axis 68 of the sweet spot 70, and the laser assembly 14 is rotated until the laser light is directed at a predetermined target. As discussed in the "Background of the invention", the laser light may be directed at the hole, the ball, or any other target a golfer may wish to use in aligning his or her stroke. The laser light is then activated when the user says "ON", or any other predetermined command. The laser light will remain on until the user says "OFF". If they user does not say "OFF", the laser light will remain on for a predetermined period of time (for example, 5 seconds) before the laser light is automatically turned off.

While the preferred embodiment has been shown and described, it will be understood that there is no intent to limit the invention by such disclosure, but rather, is intended to cover all modifications and alternate constructions falling within the spirit and scope of the invention as defined in the appended claims.

We claim:

1. A golf club laser alignment device adapted for attachment to a golf club having a ball striking face, the golf club laser alignment device comprising:

a laser assembly adapted for providing a guiding light beam used to properly align a golf club;

a mounting bracket including a distal end and a proximal end, wherein the laser assembly is mounted at the proximal end of the mounting bracket such that the laser assembly is adapted to be positioned over a sweet spot of a golf club and direct a guiding light beam at a target; and means for attaching the distal end of the mounting bracket solely to the striking face of a golf club such the laser assembly is adapted to be positioned over a sweet spot of a golf club and direct a guiding light beam at a target.

2. A laser alignment device according to claim 1, wherein the means for attaching selectively attaches the distal end of the mounting bracket to the face of a golf club.

3. A laser alignment device according to claim 2, wherein the means for attaching includes a metal plate adapted for attachment to the face of a golf club and a magnetic member on the distal end of the mounting bracket, such that the mounting bracket may be selectively secured to the face of a golf club by attaching the distal end of the mounting bracket to the properly positioned metal plate.

4. A laser alignment device according to claim 2, wherein the means for attaching includes alignment means for properly positioning the mounting bracket to the face of a golf club.

5. A laser alignment device according to claim 4, wherein the alignment means includes an aligning edge on the distal end of the mounting bracket which fits about the metal plate to properly position the mounting bracket relative to the metal plate.

6. A laser alignment device according to claim 1, wherein the laser assembly includes a housing and a plurality lateral adjustment rings removably positioned along the housing such that the lateral adjustment rings may be selectively removed from the housing to permit adjustment of the laser assembly relative to the mounting bracket.

7. A laser alignment device according to claim 6, wherein the housing of the laser assembly includes a proximal end in which a laser light is positioned and a distal end, the lateral adjustment rings being positioned between the proximal end and the distal end in a manner permitting the lateral adjustment rings to be selectively positioned relative the mounting bracket.

8. A laser alignment device according to claim 7, wherein the distal end and the proximal end of the housing are enlarged and retain the lateral adjustment rings between the distal end and the proximal end of the housing, and the distal end of the housing is selectively detachable permitting removal of the lateral adjustment rings in a manner permitting the lateral adjustment rings to be selectively positioned relative to the mounting bracket so as to adjust the position of the laser assembly relative to the mounting bracket.

9. A golf club laser alignment device adapted for attachment to a golf club having a face, the golf club alignment device comprising:

a laser assembly adapted for providing a guiding light beam used to properly align a golf club;

a mounting bracket adapted for attachment to a golf club, the mounting bracket including a distal end and a proximal end, wherein the laser assembly is mounted at the proximal end of the mounting bracket such that the laser assembly is adapted to be positioned over a sweet spot of a golf club and direct a guiding light beam at a target; and wherein the laser assembly includes a housing and a plurality lateral adjustment rings removably positioned along the housing such that the lateral adjustment rings may be selectively removed from the housing to permit adjustment of the laser assembly relative to the mounting bracket.

10. A laser alignment device according to claim 9, wherein the housing of the laser assembly includes a proximal end in which a laser light is positioned and a distal end, the lateral adjustment rings being positioned between the proximal end and the distal end of the housing in a manner permitting the lateral adjustment rings to be selectively positioned relative the mounting bracket.

11. A laser alignment device according to claim 10, wherein the distal end and the proximal end of the housing are enlarged and retain the lateral adjustment rings between the distal end and the proximal end of the housing, and the distal end of the housing is selectively detachable permitting removal of the lateral adjustment rings in a manner permitting the lateral adjustment rings to be selectively positioned relative to the mounting bracket so as to adjust the position of the laser assembly relative to the mounting bracket.

12. A laser alignment device according to claim 10, wherein an on/off switch is secured at the distal end of the housing for actuating the laser light.

13. A laser alignment device according to claim 10, wherein the distal end of the mounting bracket is adapted for attachment to a golf club and the proximal end of the mounting bracket includes an opening supporting the laser assembly; the opening being sized to permit the housing to be positioned therein such that the laser assembly is adapted to extend above the face of a golf club.

14. A laser alignment device according to claim 13, wherein the laser assembly is rotatable relative to the mounting bracket.

15. A laser alignment device according to claim 9, wherein the laser assembly is rotatable relative to the mounting bracket.

16. A golf club laser alignment device adapted for attachment to a golf club having a ball striking face, the golf club laser alignment device comprising:

a laser assembly adapted for providing a guiding light beam used to properly align a golf club;

a mounting bracket including a distal end and a proximal end, wherein the laser assembly is mounted at the proximal end of the mounting bracket such the laser assembly is adapted to be positioned over a sweet spot of a golf club and direct a guiding light beam at a target; and an attachment member mounted at the distal end of the mounting bracket, the attachment member being mounted on the distal end of the mounting bracket in a first plan which is perpendicular to a second plane in which the proximal end of the mounting bracket is positioned, wherein the mounting bracket is adapted for attachment solely to the striking face of a golf club with the laser assembly adapted to be positioned over a sweet spot of a golf club and direct a guiding light beam at a target.

17. A laser alignment device according to claim 16, wherein the attachment member selectively attaches the distal end of the mounting bracket to the face of a golf club.

18. A laser alignment device according to claim 17, further including a metal plate adapted for attachment to the face of a golf club, wherein the attachment member is magnetic such that the mounting bracket may be selectively secured to the face of a golf club by attaching the distal end of the mounting bracket to the properly positioned metal plate.

19. A laser alignment device according to claim 18, wherein the attachment member includes alignment means for properly positioning the mounting bracket to the face of a golf club.

20. A laser alignment device according to claim 19, wherein the alignment means includes an aligning edge on the distal end of the mounting bracket which fits about the metal plate to properly position the mounting bracket relative to the metal plate.

* * * * *